US010183508B2

(12) United States Patent
Itogawa

(10) Patent No.: US 10,183,508 B2
(45) Date of Patent: Jan. 22, 2019

(54) RECORDING MEDIUM POST-PROCESSING APPARATUS, PRINTER UNIT WITH THE SAME, RECORDING MEDIUM POST-PROCESSING METHOD, AND NON-TRANSITORY COMPUTER-READABLE MEDIUM STORING RECORDING MEDIUM POST- PROCESSING INSTRUCTIONS

(71) Applicant: BROTHER KOGYO KABUSHIKI KAISHA, Nagoya-shi, Aichi-ken (JP)

(72) Inventor: Yoshihiro Itogawa, Mizuho (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 85 days.

(21) Appl. No.: 15/158,763

(22) Filed: May 19, 2016

(65) Prior Publication Data

US 2016/0263918 A1 Sep. 15, 2016

Related U.S. Application Data

(60) Continuation of application No. 14/881,208, filed on Oct. 13, 2015, now Pat. No. 9,346,293, which is a division of application No. 13/749,324, filed on Jan. 24, 2013, now Pat. No. 9,180,701.

(30) Foreign Application Priority Data

Jan. 26, 2012 (JP) ..... 2012-014203

(51) Int. Cl.
*B65H 39/10* (2006.01)
*B65H 31/38* (2006.01)
(Continued)

(52) U.S. Cl.
CPC ..... *B41J 13/10* (2013.01); *B41J 13/0036* (2013.01); *B41J 13/106* (2013.01); *B41J 13/26* (2013.01);
(Continued)

(58) Field of Classification Search
CPC ..... B65H 2301/36; B65H 13/0036; B65H 39/10; B41J 13/106
See application file for complete search history.

(56) References Cited

U.S. PATENT DOCUMENTS 4,290,837 A 9/1981 Bova
6,302,606 B1 10/2001 Hayakawa
(Continued)

FOREIGN PATENT DOCUMENTS

GB 1351181 4/1974
JP 2000-264528 A 9/2000
(Continued)

OTHER PUBLICATIONS

Japanese Office Action issued in Japanese Patent Application No. 2012-014203 dated Nov. 17, 2015.

*Primary Examiner* — Jennifer E Simmons
(74) *Attorney, Agent, or Firm* — Merchant & Gould P.C.

(57) ABSTRACT

A recording medium post-processing apparatus includes: a stacker which is stacked with a plurality of sheet-like recording media with images being recorded thereon; an receiving device which receives at least one of information regarding the images to be recorded on the recording media and information regarding the recording media; an alignment device which applies an external force to the recording media stacked on the stacker so as to align the recording media; a controller which sets, on the basis of the at least one information received by the receiving device, at least one of (i) a stacked-sheet number that is the number of the recording media, and (ii) a magnitude of the external force that is applied to the recording media and which controls the alignment device on the basis of the setted at least one of the stacked-sheet number and the magnitude of the external force.

5 Claims, 5 Drawing Sheets

(51) Int. Cl.

| | |
|---|---|
| ***B41J 13/26*** | (2006.01) |
| ***B41J 13/10*** | (2006.01) |
| ***B41J 13/00*** | (2006.01) |
| ***B65H 31/40*** | (2006.01) |
| ***B65H 43/06*** | (2006.01) |
| *B41J 2/01* | (2006.01) |

(52) U.S. Cl.
CPC ..... *B65H 31/38* (2013.01); *B65H 31/40* (2013.01); *B65H 39/10* (2013.01); *B65H 43/06* (2013.01); *B41J 2/01* (2013.01); *B65H 2301/36* (2013.01); *B65H 2301/363* (2013.01); *B65H 2301/4213* (2013.01)

(56) References Cited

U.S. PATENT DOCUMENTS

| | | | | |
|---|---|---|---|---|
| 6,382,616 | B1 * | 5/2002 | Waragai | B65H 9/04 270/58.08 |
| 6,712,924 | B2 | 3/2004 | Silverbrook | |
| 2001/0020765 | A1 * | 9/2001 | Araki | B65H 3/0669 271/125 |
| 2007/0235917 | A1 | 10/2007 | Nagasako et al. | |
| 2008/0185768 | A1 | 8/2008 | Enenkel | |
| 2010/0194020 | A1 * | 8/2010 | Iguchi | B65H 39/10 270/58.07 |
| 2011/0006476 | A1 | 1/2011 | Morita et al. | |
| 2011/0062647 | A1 | 3/2011 | Tsuchiya | |

FOREIGN PATENT DOCUMENTS

| | | | |
|---|---|---|---|
| JP | 2007-204270 | A | 8/2007 |
| JP | 2008-13340 | A | 1/2008 |
| JP | 2010-260660 | A | 11/2010 |
| JP | 2011-16652 | A | 1/2011 |

* cited by examiner

RECORDING MEDIUM POST-PROCESSING APPARATUS, PRINTER UNIT WITH THE SAME, RECORDING MEDIUM POST-PROCESSING METHOD, AND NON-TRANSITORY COMPUTER-READABLE MEDIUM STORING RECORDING MEDIUM POST- PROCESSING INSTRUCTIONS

CROSS REFERENCE TO RELATED APPLICATION

The present application is a continuation of U.S. patent application Ser. No. 14/881,208, filed Oct. 13, 2015, which is a divisional application based on application Ser. No. 13/749,324, filed Jan. 24, 2013, and further claims priority from Japanese Patent Application No. 2012-014203, filed Jan. 26, 2012, the disclosures of all of which are herein incorporated by reference in their entirety.

BACKGROUND OF THE INVENTION

Field of the Invention

The present invention relates to a post-processing of a recording medium which is ejected from an image forming apparatus such as a printer, a copying machine, and the like, and, in particular, to a recording medium post-processing apparatus for aligning the recording medium, a printer unit having the recording medium post-processing apparatus, a recording medium post-processing method, and a non-transitory, computer-readable medium storing a recording medium post-processing program for aligning the recording medium.

Description of Related Art

In recent years, there is a sheet post-processing apparatus which is provided to an image forming apparatus such that the sheet post-processing apparatus is adjacent to the image forming apparatus. The sheet post-processing apparatus aligns a plurality of sheets after the sheets are supplied from the image forming apparatus There is known a sheet post-processing apparatus which has a waiting tray that temporarily accommodates a plurality of sheets supplied from the image forming apparatus, a processing tray that is placed below the waiting tray and applies an external force to the plurality of sheets dropped from the waiting tray so as to align them, and a sheet receiving tray which is stacked with the plurality of sheets after the sheets were aligned on the processing tray and then discharged from the processing tray. The number of the sheets to be stacked on the sheet receiving tray at a time is restricted on the basis of the number of the sheets that are allowed to be accommodated in the waiting tray. Therefore, before the sheets having been aligned on the processing tray is going to be discharged to the sheet receiving tray, the sheets that had been stacked on the sheet receiving tray in advance are forced out to prevent the sheets having been aligned on the processing tray from contacting with the sheets that had been stacked on the sheet receiving tray in advance so as to disarrange them.

SUMMARY OF THE INVENTION

The friction coefficient of a recorded surface of the recording medium on which an image is recorded varies in accordance with a surface condition of the recorded surface, such as an area of a region on which an image is recorded with an medium like an ink, a type of the sheet, and so on. Accordingly, a magnitude of the external force to be applied for aligning the plurality of recording media also varies in accordance with the surface condition of the recorded surface. In conventional recording medium post-processing apparatuses, since the external force to be applied for aligning the plurality of recording media does not vary in a variation of the surface condition on the recorded surface, the recording media stacked on the processing tray may be discharged to the sheet receiving tray without the recording media being correctly aligned.

It is an object of the present invention to provide an apparatus which correctly aligns the plurality of recording media irrespective of the surface condition on the recorded surface of the recording medium.

The object indicated above may be achieved according to the present invention which provides a recording medium post-processing apparatus comprising: a stacker configured to be stacked with a plurality of sheet-like recording media with images being recorded thereon; an receiving device configured to receive at least one of information regarding the images to be recorded on the recording media and information regarding the recording media; an alignment device configured to apply an external force to the plurality of recording media stacked on the stacker so as to align the plurality of recording media stacked on the stacker; and a controller configured to set, on the basis of the at least one information received by the receiving device, at least one of (i) a stacked-sheet number that is the number of the plurality of the recording media stacked on the stacker, at a time when the alignment device is driven, and (ii) a magnitude of the external force that is applied to the plurality of the recording media stacked on the stacker, at the time when the alignment device is driven, and which is configured to control the alignment device on the basis of the setted at least one of the stacked-sheet number and the magnitude of the external force.

DETAILED DESCRIPTION OF THE PREFERRED EMBODIMENTS

An embodiment according to the present invention is described below in detail with reference to the figures. In this embodiment, a paper sheet for printing is illustrated as an example of the recording medium.

Figure 1:
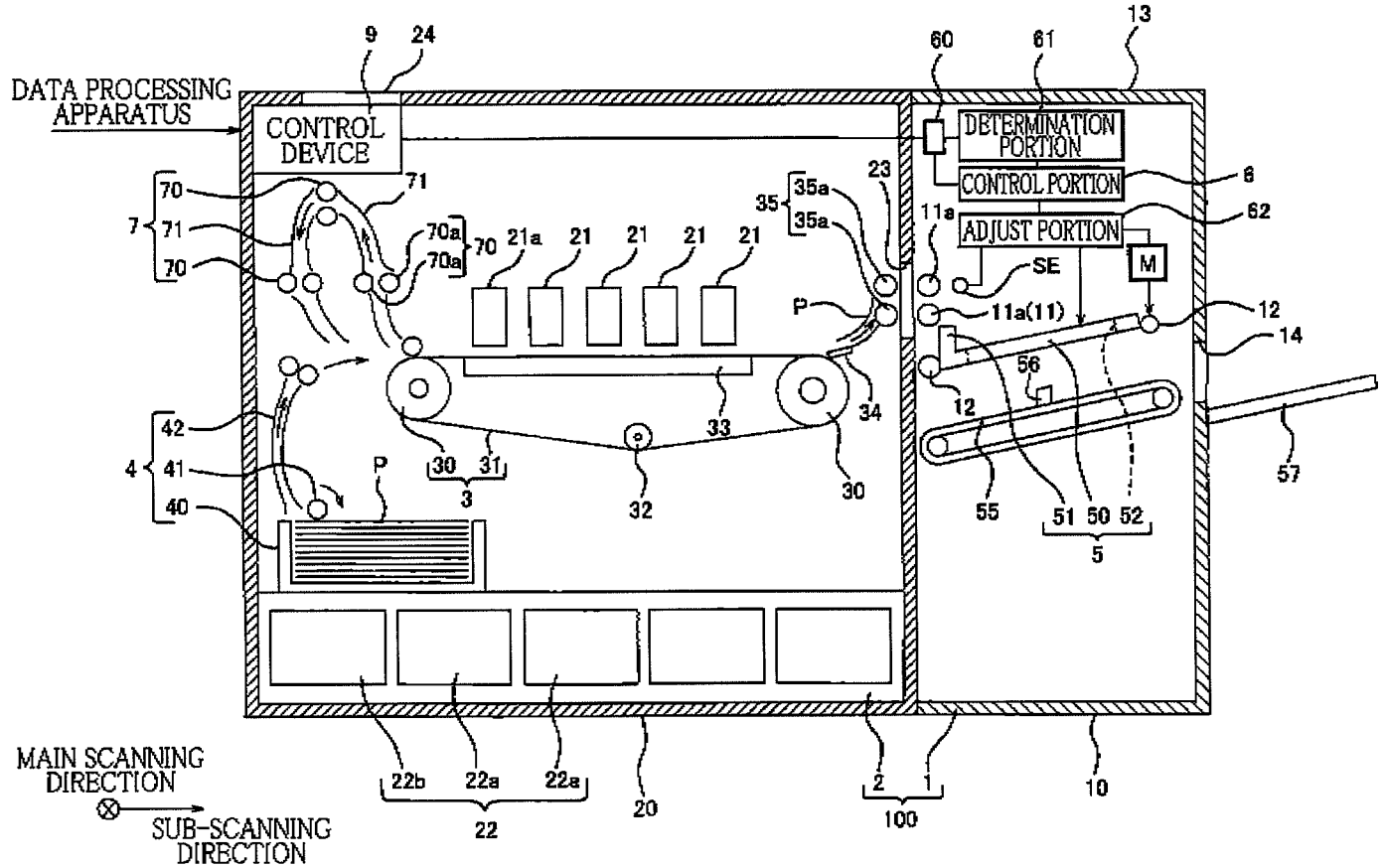
FIG. 1 is a front view showing internal constructions of the image forming apparatus and the recording medium post-processing apparatus.

As shown in FIG. 1, a recording medium post-processing apparatus 1, which is described below, is provided to an image forming apparatus 2 such that the recording medium post-processing apparatus 1 is placed next to the image forming apparatus 2. Thus, the image forming apparatus 2 and the recording medium post-processing apparatus 1 constitutes a printer unit 100. It is noted that, in the embodiment, the image forming apparatus 2 is an ink-jet printer which ejects inks onto the sheet for performing a printing.

The image forming apparatus 2 has a housing 20 having an approximately rectangular parallelepiped shape. In the housing 20, there are arranged, from an upside thereof to a downside thereof, five heads 21, 21*a*, a conveyor mechanism 3, a sheet supply unit 4, and a tank group 22. The five heads 21, 21*a* are arranged along the horizontal plane, and the heads 21 eject respective inks onto the sheet P and the head 21*a* ejects treatment liquid onto the sheet P. The conveyor mechanism 3 is arranged immediately below the five heads 21, 21*a*, and conveys the sheet P in a forward conveying direction (a direction from a left side to a right side in FIG. 1) or in a direction opposite to the forward conveying direction. The sheet supply unit 4 supplies the sheets P accumulated thereon one by one to the conveyor mechanism 3. The tank group 22 is constituted by a plurality of aligned tanks 22*a*, 22*b* storing inks of four colors and the treatment liquid. In an upper portion of the housing 20, there are provided a control device 9 which supervises operations of the heads 21 and an operation of the conveyor mechanism 3.

The conveyor mechanism 3 conveys the sheet P onto which the ink or the treatment liquid have been ejected by the heads 21, 21*a*, to the recording medium post-processing apparatus 1 through a first through opening 23 which is opened on a side face of the housing 20. On a top face of the housing 20, there is provided a first panel 24 to which a user manually inputs operation information, and the first panel 24 is connected to a control device 9.

Four of the five heads are ink heads 21 which eject the respective inks of four colors i.e. black, cyan, magenta, and yellow. The remaining one head is a treatment liquid head 21*a* which is placed at the most upstream side in the forward conveying direction and ejects the treatment liquid onto the sheet P. The ink heads 21 are connected via respective tubes (not shown) to the tanks 22*a* storing the respective inks each of which corresponds to each of the four colors. The treatment liquid head 21*a* is connected via a tube (not shown) to the tank 22*b* storing the treatment liquid.

Incidentally, each of the ink heads 21 includes a reservoir unit which temporarily stores the ink, a channel unit which is formed by stacking a plurality of metal plates each having almost the same size, and an actuator unit having piezoelectric layers, a pressure chamber, and an electrode. Thus, each of the ink heads 21 has a known construction. In addition, the treatment liquid head 21*a* has the similar construction as the ink head 21, and then a detailed description thereof is omitted.

The image forming apparatus 2 is a line-type printer, and each of the heads 21, 21*a* extends horizontally in a direction orthogonal to the conveying direction of the sheet P. The direction orthogonal to the conveying direction of the sheet P is referred to as a main scanning direction, and a direction along the conveying direction of the sheet P is referred to as a sub-scanning direction.

The treatment liquid is a liquid which, before the ink is ejected onto the sheet P, is ejected onto the sheet P so as to result in precipitating or coagulating a component of the ink, whereby a high printing quality is maintained and an image quality is improved. A treatment in which the treatment liquid is ejected prior to the ejection of the ink is referred to as a pre-coat treatment or a coat treatment. Therefore, where the user intentionally operates the first panel 24 to eliminate the pre-coat treatment prior to a printing, the control device 9 recognizes the intention so as to command the treatment liquid head 21*a* not to eject the treatment liquid onto the sheet P.

The sheet supply unit 4 includes a sheet supply tray 40 on which the plurality of sheets P are accumulated and accommodated, a sheet supply roller 41 which sends the sheet P upward that has been picked up one by one from the sheet supply tray 40, and a guide 42 which guides the sheet P having been sent upward by the sheet supply roller 41 to the conveyor mechanism 3.

The conveyor mechanism 3 includes belt rollers 30, 30 which are disposed in an upstream side and a downstream side, respectively, in the forward conveying direction of the sheet P, an endless belt 31 which is wound around both of the belt rollers 30, 30, a tension roller 32 which is for applying a tensile force to the endless belt 31, and a platen 33 which is placed inside the endless belt 31 so as to face to bottom faces of the heads 21, 21*a*. One of the belt rollers 30 is rotated by a motor (not shown), whereby the endless belt 31 conveys the sheet P in the forward conveying direction.

In a downstream side of the conveyor mechanism 3, there is provided a peeling plate 34 which peels off the sheet P from the conveyor mechanism 3. The sheet P having been peeled off at the peeling plate 34 is sent to the recording medium post-processing apparatus 1 by a first conveyor roller pair 35 which is placed so as to face the first through opening 23. The first conveyor roller pair 35 is constituted by two conveyor rollers 35*a* which face to each other with the sheet P being positioned therebetween.

Between the belt roller 30 placed in the left side on FIG. 1 and the sheet supply unit 4, there is provided a two-side recording mechanism 7 which is used for performing a two-side printing on the sheet P. The two-side recording mechanism 7 includes a plurality of sheet re-supply roller pairs 70 which are spaced apart from each other, and a plurality of guides 71 which guide the sheet P between the sheet re-supply roller pairs 70. The two-side recording mechanism 7 conveys the sheet P along a sheet flipping path defined by the plurality of guides to have a loop shape. The sheet re-supply roller pairs 70 is constituted by two sheet re-supply rollers 70*a* which face to each other with the sheet P being positioned therebetween.

The belt rollers 30 and the first conveyor roller pair 35 are rotated in a direction opposite to a direction of the rotation for the forward conveying direction, thereby conveying the sheet P in a direction opposite to the forward conveying direction. This opposite direction is hereinafter referred to as a backward conveying direction. When the two-side printing is performed, the sheet P is conveyed in the forward conveying direction so as to perform a printing on one side of the sheet P, thereafter the first conveyor roller pair 35 and the belt rollers 30 are reversely rotated so as to convey the sheet P in the backward conveying direction. The sheet P is passed through the guides 71 by the sheet re-supply roller pairs 70, and is sent to the conveyor mechanism 3 again with the sheet P being reversed. The belt rollers 30 are reversely rotated again so as to convey the sheet P in the forward conveying direction, and a printing is performed on the other side of the sheet P.

The control device 9 is specifically a CPU, in which an internal operation clock is divided and is used as a timer. To the control device 9, a print job including print data is inputted from an external data processing apparatus, for example, a personal computer. The control device 9 can calculate, from a data amount included in the print job, an area on the sheet P where a printing will be performed. The control device 9 also can calculate, from the data amount included in the print job, an ejection amount of the inks from the ink heads 21. Moreover, since the control device 9 is connected to the first panel 24, information regarding whether or not the pre-coat treatment is performed, information regarding whether or not the two-side printing is performed, information regarding a type of the sheet P, and information regarding whether or not a printing on a next sheet P is performed, are inputted to the control device 9. Since the control device 9 has a timer function, it can calculate a period required from an end of a certain printing to an end of a next printing.

Recording Medium Post-Processing Apparatus

The recording medium post-processing apparatus 1 includes a second conveyor roller pair 11, a stacker 5, an eccentric roller 12, and a motor M. The second conveyor roller pair 11 conveys the printed sheet P which has been conveyed into a housing 10 through the first through opening 23, to an inside of the recording medium post-processing apparatus 1. On the stacker 5, the plural sheets P conveyed by the second conveyor roller pair 11 are stacked and arranged. The eccentric roller 12 contacts to the stacker 5 so as to vibrate the stacker 5 in a direction along a recorded surface of the sheet P or a direction orthogonal to the recorded surface. The motor M rotates the eccentric roller 12. The second conveyor roller pair 11 is constituted by two conveyor rollers 11*a* which face to each other with the sheet P being positioned therebetween.

In a downstream side of the second conveyor roller pair 11 in the conveying direction, there is disposed a count sensor SE which counts the number of the sheets P which have been conveyed by the second conveyor roller pair 11. On a top face of the housing 10, there is provided a second panel 13 to which the user inputs information indicating a use of an alignment function of the stacker 5 of the recording medium post-processing apparatus 1.

Figure 2A:
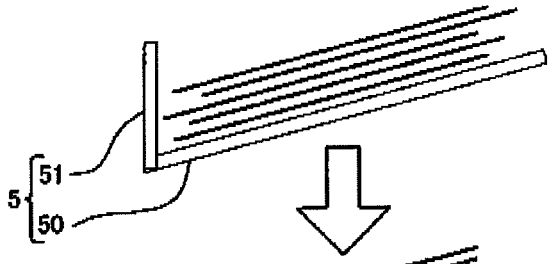
FIGS. 2 (*a*) and (*b*) are schematic views showing a sheet aligning operation of the stacker.
Figure 2B:
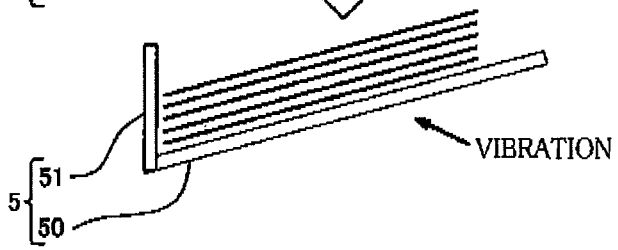

The stacker 5 includes a bottom plate 50 which supports a bundle of the sheets P, and a wall piece 51 which is provided, in FIG. 1, at a left edge of the bottom plate 50, in other words, an end portion of the bottom plate 50 which is placed nearer to the image forming apparatus 2. In the bottom plate 50, there are provided an opening 52 for dropping the bundle of the sheets P, and an open-close mechanism (not shown) which switches an opening state and a closing state of the opening 52. As shown in FIG. 2(*a*), the bottom plate 50 of the stacker 5 is tilted such that the left edge thereof is lower than a right edge thereof. Therefore, the vibration of the stacker 5 aligns the arranged plural sheets P such that left edges thereof are uniformly positioned.

Below the stacker 5, there is disposed a conveyor 55 which supports the bundle of the sheets P having been dropped from the stacker 5, and, on the conveyor 55, there is provided a claw piece 56 which lightly touches to a side edge of the bundle of the sheets P. On an outer wall of the housing 10, and in a side of the stacker 5 which is opposite to a side in which the image forming apparatus 2 is placed, there is formed a second through opening 14 through which the bundle of the sheets P can pass. The conveyor 55 conveys the bundle of the sheets P toward the second through opening 14. In an outside of the housing 10, there is provided a sheet receiving tray 57 which supports the bundle of the sheets P having passed through the second through opening 14.

Figure 3:
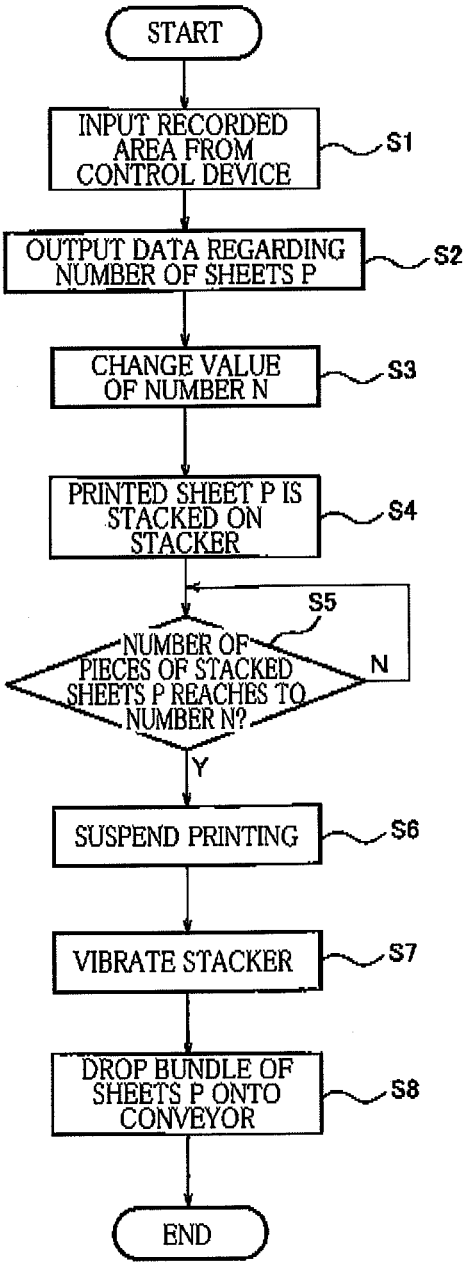
FIG. 3 is a flow chart representing an operation of the recording medium post-processing apparatus.

In the housing 10 of the recording medium post-processing apparatus 1, there are disposed an receiving device 60 which receives a signal from the control device 9, and a determination portion 61 which is connected to the receiving device 60. The determination portion 61 is connected to the control portion 6 to which an adjust portion 62 is connected. The adjust portion 62 supplies an electricity to the motor M. Since the control portion 6 controls the adjust portion 62 which supplies the electricity to the motor M, the control portion 6 indirectly controls the motor M. The control portion 6 is also connected to the receiving device 60. Additionally, the control portion 6 has a CPU which executes a program whose flow chart is shown in FIG. 3, and a memory which stores the program, various values, and so on.

The receiving device 60 receives information inputted from the control device 9, and the information is then inputted to the determination portion 61. The information includes, for example, information regarding an image to be recorded on the sheet P and information regarding the sheet P, more specifically, information regarding the area of the recorded surface, information regarding the ejection amount of the inks from the ink heads 21, information regarding whether or not the pre-coat treatment is performed, information regarding whether or not the two-side printing is performed, and information regarding the recorded surface such as a type of the sheet P which was inputted by the user from the first panel 24.

The determination portion 61 is, for example, a microcomputer, which has a table. The table stores data regarding the number of the sheets P which is to be stacked on the stacker 5 in accordance with the information regarding the recorded surface, data regarding an electric voltage which is to be supplied to the motor M in order to vibrate the stacker 5 with a determined amplitude, data regarding a duration of supplying the electricity, and the like. Accordingly, when the information regarding the recorded surface of the sheet P is inputted, the determination portion 61 outputs, to the control portion 6, data regarding a value of the number of the sheets P which is to be stacked on the stacker 5 in accordance with the information, a value of the electric voltage which is to be supplied to the motor M in accordance with the information, a value of the duration of supplying the electricity in accordance with the information, and so on. The adjust portion 62 is connected to the open-close mechanism of the stacker 5 and switches stacking the sheets P on the stacker 5 and dropping the sheets P.

Additionally, the adjust portion 62 is connected to the count sensor SE, whose output is inputted to the adjust portion 62. The adjust portion 62 is, for example, a CPU, and has a memory with a small capacity (not shown). The memory temporarily stores the number N of the sheets P which is to be stacked on the stacker 5. Additionally, in the adjust portion 62, an internal operation clock is divided and is used as a timer.

Operation of Recording Medium Post-Processing Apparatus

First Embodiment

The user operates the first panel 24 of the image forming apparatus 2 so as to perform a printing on the sheet P, and operates the second panel 13 of the recording medium post-processing apparatus 1 so as to align the bundle of the stacked sheets P. The recording medium post-processing apparatus 1 performs an operation illustrated in the flow chart of FIG. 3.

At first, the image forming apparatus 2 is in a print stand-by state and does not start a printing soon. As described below, the image forming apparatus 2 starts a printing after receiving, from the recording medium post-processing apparatus 1, a signal indicating that a start of a printing is ready.

As described above, the control device 9 can calculate, from the data amount included in the print job, the recorded area on the sheet P, that is, an amount of the area on which the printing is performed. Since the control device 9 is connected to the determination portion 61 via the receiving device 60, the recorded area on the sheet P is inputted (step S1). That is, the information received by the receiving device 60 includes information regarding the image to be recorded on the sheet P. As the recorded area on the sheet P is larger, a friction resistance on the recorded surface becomes larger, and, as the recorded area is smaller, the friction resistance on the recorded surface becomes smaller. The determination portion 61 outputs, to the control portion 6, the data regarding the number of the sheets P which is to be stacked on the stacker 5 in accordance with the recorded area (step S2). That is, the determination portion 61 determines a stacked-sheet number on the basis of the area of the images recorded on the plurality of sheets stacked on the stacker 5.

In detail, as the recorded area on the sheet P is larger, the friction resistance on the recorded surface becomes larger, that is, the friction resistance between the adjoined sheets P becomes larger. Therefore, the determination portion 61 sends, to the control portion 6, a signal for a command that the number of the sheets P which is to be stacked on the stacker 5 is reduced. On the contrary, as the recorded area on the sheet P is smaller, the friction resistance on the recorded surface becomes smaller, that is, the friction resistance between the adjoined sheets P becomes smaller. Therefore, the determination portion 61 sends, to the control portion 6, a signal for a command that the number of the sheets P which is to be stacked on the stacker 5 is reduced. Additionally, the number of the sheets P, in this case, which is to be stacked on the stacker 5 is larger than the number of the sheets P, in the case in which the recorded area on the sheet P is larger, which is to be stacked on the stacker 5.

The control portion 6 changes, on the basis of the signal from the determination portion 61, a value of the number N stored in the memory of the adjust portion 62, which is the number of the sheets P which is to be stacked on the stacker 5 (step S3). Afterward, the control portion 6 sends, to the control device 9, a signal indicating that a start of a printing is ready.

In the image forming apparatus 2, the sheet supply roller 41 rotates to pick up the sheet P from the sheet supply tray 40, and the sheet P is sent to the conveyor mechanism 3. While the sheet P is conveyed by the conveyor mechanism 3 in the forward conveying direction, the inks are ejected from the heads 21 so that a printing is performed on the sheet P.

The printed sheet P is put through the first through opening 23 to enter into the housing 10 of the recording medium post-processing apparatus 1, and is stacked on the stacker 5 by the second conveyor roller pair 11 (step S4). When the adjust portion 62 detects, by the output of the count sensor SE, that the sheets P of the number N stored in the memory of the adjust portion 62, have been stacked on the stacker 5, the control portion 6 sends a signal for indicating the detection (step S5). The control portion 6 sends a signal for a command of temporarily suspending the printing, to the control device 9 of the image forming apparatus 2 via the receiving device 60. The control device 9 receives this signal and then suspends the printing (step S6).

Afterward, the control portion 6 orders the adjust portion 62 to function for supplying the electricity to the motor M. Since the motor M is joined to the eccentric roller 12, the rotation of the eccentric roller 12 vibrates the stacker 5 (step S7). As a result, the sheets P on the stacker 5 move against the friction resistances on the recorded surfaces. Since the bottom plate 50 of the stacker 5 is tilted such that the left edge thereof is lower than the right edge thereof, the stacked sheets P are aligned such that left edges thereof come into abutting contact with the wall piece 51. That is, the motor M constitutes the alignment device which applies an external force to the sheets P on the stacker 5 so as to align the plurality of sheets P stacked on the stacker 5. In addition, the adjust portion 62 sets the stacked-sheet number that is the number of the plurality of the sheets P stacked on the stacker 5, at a time when the motor M is driven.

The adjust portion 62 supplies the electricity to the motor M for a set period so as to vibrate the stacker 5. A value of the set period and a value of an electric voltage supplied to the motor M are values stored in the table of the determination portion 61. Therefore, the bundle of the printed sheets P on the stacker 5 can be correctly aligned irrespective of the recorded area on the sheet P.

After the set period passes, the adjust portion 62 stops the supply of the electricity to the motor M and then orders the open-close mechanism of the stacker 5 to drop the bundle of the sheets P having been aligned on the stacker 5 onto the conveyor 55 (step S8). In a state in which the claw piece 56 of the conveyor 55 lightly touches to the side edge of the bundle of the sheets P, the conveyor 55 conveys the bundle of the sheets P to the second through opening 14. The bundle of the sheets P goes through the second through opening 14 to be placed on the sheet receiving tray 57. In this state, the user can pick up the bundle of the printed and aligned sheets P from the sheet receiving tray 57. When a certain period has passed since the adjust portion 62 stopped the supply of the electricity to the motor M, the control portion 6 outputs a signal indicating that a re-start of a printing is ready, to the control device 9 of the image forming apparatus 2 via the receiving device 60. This certain period is a period of time which is enough but not too long to send the bundle of the sheets P aligned on the stacker 5 to the sheet receiving tray 57 after the bundle had dropped onto the conveyor 55. The image forming apparatus 2 re-starts the printing, when the printing is not completed yet.

After the printing is performed on the sheet P, the friction resistance on the recorded surface is different from the friction resistance prior to the printing in accordance with a state of the recorded surface of the sheet P. Accordingly, the stacked-sheet number of the sheets P in which correctly aligning the sheets P stacked on the stacker 5 is allowed varies in accordance with a state of the recorded surface. In the light of this, the control portion 6 controls the adjust portion 62 and the motor M (constituting the alignment device) on the basis of the data regarding the stacked-sheet number of the sheets P which were outputted from the determination portion 61. Accordingly, the control portion 6 and the adjust portion 62 constitutes the controller which sets the stacked-sheet number on the basis of the at least one information received by the receiving device 60, and controls the motor M on the basis of the setted stacked-sheet number. Therefore, the bundle of the printed sheets P can be correctly aligned irrespective of the recorded area.

Second Embodiment

As described above, the information regarding the ejection amount of the inks on the sheets P is inputted from the control device 9 to the determination portion 61 via the receiving device 60. That is, the information received by the receiving device 60 includes information regarding the image to be recorded on the sheet P. The determination portion 61 outputs, to the control portion 6, data regarding a value of the number of the sheets P which is to be stacked on the stacker 5 in accordance with the information regarding the ejection amount, a value of the electric voltage which is to be supplied to the motor M in accordance with the information, and so on.

In detail, since each of the inks has a certain viscosity, the friction coefficient on the recorded surface becomes larger as the ejection amount of the inks is larger. Consequently, the friction resistance between the adjoined sheets P becomes larger. Therefore, the determination portion 61 sends, to the control portion 6, a signal for a command that the number of the sheets P which is to be stacked on the stacker 5 is reduced.

On the contrary, when the ejection amount of the inks is small, the friction coefficient on the recorded surface becomes smaller than that in the large ejection amount. Therefore, the friction resistance between the adjoined sheets P becomes smaller. Therefore, the determination portion 61 sends, to the control portion 6, a signal for a command that the number of the sheets P which is to be stacked on the stacker 5 is reduced. Then, the number of the sheets P, in this case, which is to be stacked on the stacker 5 is larger than the number of the sheets P, in the case of the large ejection amount, which is to be stacked on the stacker 5.

The control portion 6 changes, on the basis of the output from the determination portion 61, the value of the number N stored in the memory of the adjust portion 62, which is the number of the sheets P which is to be stacked on the stacker 5.

Afterward, the printing on the sheets P is started in the image forming apparatus 2 and the printing has been performed on the N pieces of the sheets P, then the printing in the image forming apparatus 2 is temporarily suspended. Next, the stacker 5 is vibrated to align the N pieces of the sheets P, as described above.

Therefore, the bundle of the printed sheets P on the stacker 5 can be correctly aligned irrespective of the ejection amount of the inks.

Third Embodiment

In this embodiment, the stacked printed sheets P are aligned in a period from a time when the printed sheets P has supplied to the recording medium post-processing apparatus 1 to a time when a next sheet P is supplied to the recording medium post-processing apparatus 1. The reason is because forming an image by ejecting the inks on the sheet P may require a certain period of time in accordance with a type of the image. That is, an idle time may occur. In addition, the idle time may also occur in accordance with a type of the ejected ink, an ejection period of the ink, and a type of the sheet P, because it take a while to dry the ink. This idle time is utilized for the stacked printed sheets P to be aligned.

The control device 9 can calculate a period required for completing a printing by using the inputted print job and the information regarding the type of the sheet P and so on that had been inputted to the first panel 24 by the user.

Accordingly, after the set number N pieces of the sheets P are stacked on the stacker 5, information regarding when a next sheet P is supplied from the image forming apparatus 2 to the recording medium post-processing apparatus 1 may be inputted to the determination portion 61. That is, the information inputted to the receiving device 60 includes information regarding the recording medium. To the determination portion 61, a threshold of the period from the time when the printed sheets P has supplied from the image forming apparatus 2 to the time when the next recording medium P is supplied from the image forming apparatus 2, is inputted beforehand.

The determination portion 61 determines, using the information from the control device 9, that the period required for the next recording medium P to be supplied to the recording medium post-processing apparatus 1 is greater than the threshold, that is, the period is a longer time than the threshold. Then, the determination portion 61 notifies the determination to the control portion 6. Additionally, the determination portion 61 outputs, to the control portion 6, a signal indicating the value of the electric voltage which is to be supplied to the motor M in accordance with the recorded area on the sheet P and the ejection amount of the inks. That is, when the recorded area on the sheet P is larger, the determination portion 61 outputs, to the control portion 6, a signal indicating that the value of the electric voltage is more increased. And, when the ejection amount of the inks is larger, the determination portion 61 outputs, to the control portion 6, a signal indicating that the value of the electric voltage is more increased. The control portion 6 orders the adjust portion 62 to function. The adjust portion 62 puts the motor M in driving so as to align the bundle of the sheets P after the sheet P had been supplied from the image forming apparatus 2 and within a period corresponding to the threshold. That is, in this embodiment, the threshold is the first period which is a period from the time when the last stacked sheet P of the plurality of the sheets P stacked on the stacker 5 has been stacked to the time when the next sheet P is stacked on the stacker 5. This threshold preferably has an enough length in which the sheets P are aligned correctly after the stacker 5 has been vibrated.

The adjust portion 62 puts the motor M in driving so as to align the stacked printed sheets in the period from the time when the printed sheets P has supplied to the recording medium post-processing apparatus 1 to the time when the next recording medium P is supplied to the recording medium post-processing apparatus 1. Therefore, the alignment can be implemented without affecting a speed of the printing on the sheets P.

Fourth Embodiment

When the two-side printing is performed on the sheet P by using the two-side recording mechanism 7, it means that the user had operated the first panel 24 for performing the two-side printing. Accordingly, information indicating that the two-side printing is performed on the sheet P which is supplied from the image forming apparatus 2 to the recording medium post-processing apparatus 1 is inputted from the control device 9 to the determination portion 61. That is, the information received by the receiving device 60 includes information regarding whether or not two-side printing is performed.

When the two-side printing is performed on the sheet P, the sheet P adjoins other sheets P on both surfaces thereof such that their recorded surfaces contact to each other. Thus, the friction resistance between the adjoined sheets P in a case in which the two-side printing is performed is larger than that in a case in which a one-side printing is performed on each of the sheets P. Therefore, the determination portion 61 sends, to the control portion 6, a signal for a command that the number of the sheets P which is to be stacked on the stacker 5 is reduced compared to the case of the one-side printing. The control portion 6 reduces, on the basis of the data from the determination portion 61, the value of the number N stored in the memory of the adjust portion 62, which is the number of the sheets P which is to be stacked on the stacker 5.

Afterward, the printing on the sheets P is started in the image forming apparatus 2 and the printing has been performed on the N pieces of the sheets P, then the printing in the image forming apparatus 2 is temporarily suspended. Next, the stacker 5 is vibrated to align the N pieces of the sheets P, as described above.

In this embodiment, the adjust portion 62 reduces the stacked-sheet number of the sheets P in a vibration of the stacker 5, compared to the case of the one-side printing. Therefore, the stacked sheets P are correctly aligned even though the two-side printing is performed on the sheet P.

Fifth Embodiment

The type of the sheet P includes a common high-quality paper as well as a coated paper whose surfaces are coated with a coating agent for ink-jet printers, a coarse paper used for newspapers and magazines, and so on. The friction coefficient on the recorded surface varies in accordance with the type of the sheet P. For example, since the coated paper for ink-jet printers has a tendency, in a printing, for the ink to stay on a surface, the friction coefficient on the recorded surface becomes larger than that of the high-quality paper. Additionally, since the coarse paper has a coarse surface, the friction coefficient on the recorded surface becomes larger than that of the high-quality paper.

Therefore, when information indicating that the sheet P is such a coated paper or a coarse paper etc. is inputted from the control device 9 to the determination portion 61, the determination portion 61 reduces the value of the number N stored in the memory of the adjust portion 62, which is the number of the sheets P which is to be stacked on the stacker 5, compared to the case in which the paper P is the high-quality paper. Therefore, the stacked sheets P can be correctly aligned, irrespective of the type of the sheet P, by changing, on the basis of the type of the sheet P, the number of the sheets P which is to be stacked on the stacker 5.

The printing on the sheets P is started in the image forming apparatus 2 and the printing has been performed on N pieces of the sheets P, then the printing in the image forming apparatus 2 is temporarily suspended. Next, the stacker 5 is vibrated to align the N pieces of the sheets P, as described above.

Sixth Embodiment

When the user intends to perform a pre-coat treatment on the sheet P, it means that the user operates the first panel 24 for ordering the intention. Accordingly, information indicating that the pre-coat treatment is performed on the sheet P supplied from the image forming apparatus 2 is inputted from the control device 9 to the determination portion 61.

The friction coefficient on the recorded surface of the sheet P varies in accordance with a presence or absence of the pre-coat treatment, that is, on the basis that whether or not the pre-coat treatment is performed. In detail, since the treatment liquid for the pre-coat treatment has a certain viscosity, the friction coefficient on the recorded surface in a case in which the pre-coat treatment is performed becomes larger than that in a case of no pre-coat treatment. Therefore, the number of the sheets P which is to be stacked on the stacker 5 needs to be reduced.

The determination portion 61 sends, on the basis of the information from the control device 9, a signal for a command that the number of the sheets P which is to be stacked on the stacker 5 is reduced, to the control portion 6. The control portion 6 reduces the value of a number N stored in the memory of the adjust portion 62, which is the number of the sheets P which is to be stacked on the stacker 5, compared to the case of no pre-coat treatment.

As described above, the stacked sheets P can be correctly aligned, irrespective of the presence or absence of the pre-coat treatment, by changing, on the basis of the presence or absence of the pre-coat treatment, the number of the sheets P which is to be stacked on the stacker 5.

The printing on the sheets P is started in the image forming apparatus 2, and the printing has been performed on N pieces of the sheets P, and then the printing in the image forming apparatus 2 is temporarily suspended. Next, the stacker 5 is vibrated to align the N pieces of the sheets P, as described above.

Other Embodiments

In the aforementioned embodiments, the number of the sheets P which is to be stacked on the stacker 5 is changed on the basis of a condition of the recorded surface of the sheet P, and the sheets P are aligned by vibrating the stacker 5 with the motor M and the eccentric roller 12. Alternatively, the stacker 5 may be vibrated with a vibrator (not shown), instead of the motor M and the eccentric roller 12, so as to increase and decrease the amplitude of the stacker 5 in accordance with the condition of the recorded surface of the sheet P. In detail, the amplitude of the stacker 5 is increased when the friction coefficient or the friction resistance on the recorded surface is large, and the amplitude of the stacker 5 is decreased when the friction coefficient or the friction resistance is small. In addition, on the basis of the recorded surface of the sheet P, the number of the sheets P which is to be stacked on the stacker 5 may be changed and the amplitude of the stacker 5 may be increased and decreased.

Figure 4:
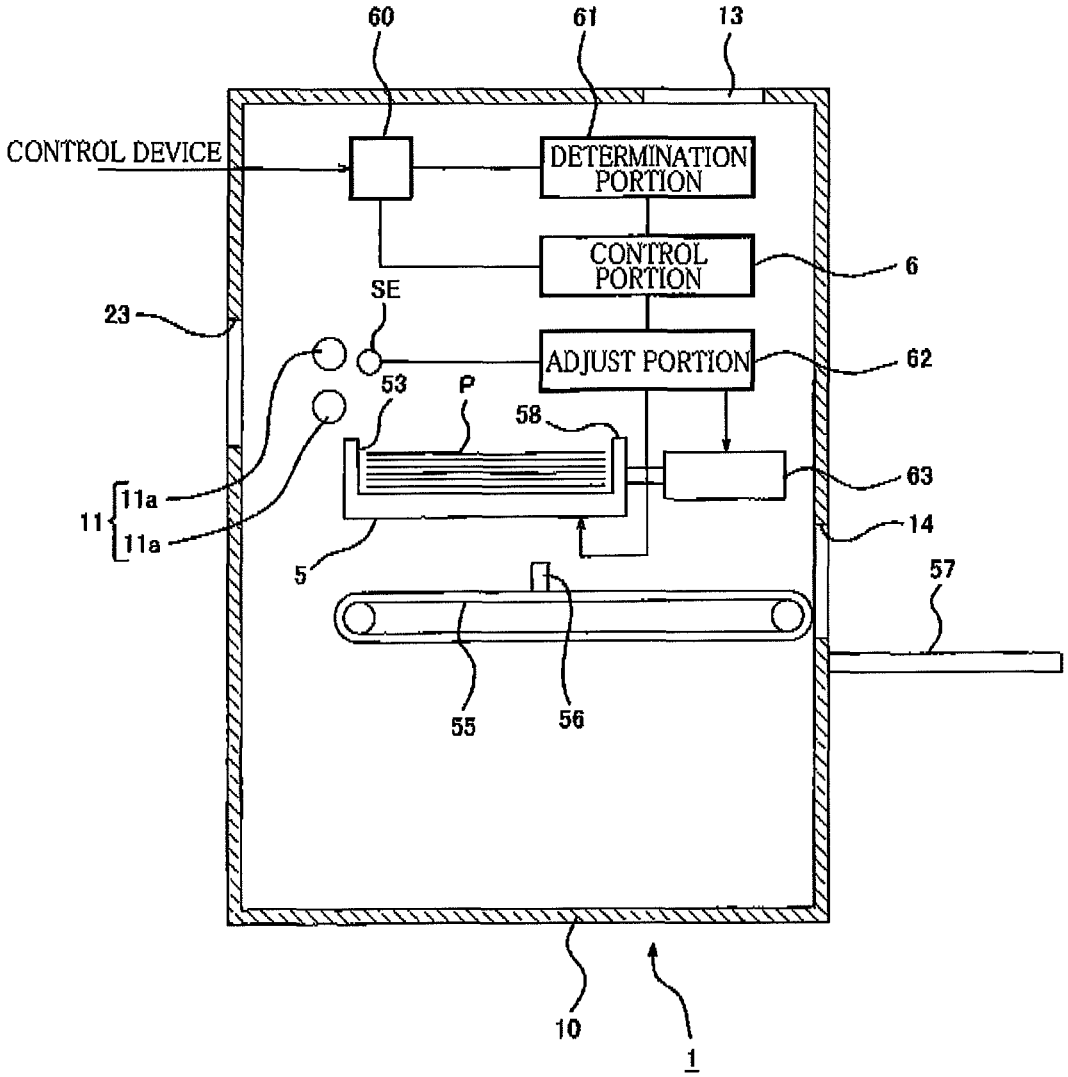
FIG. 4 is a front view showing an internal construction of another recording medium post-processing apparatus having another stacker.

In the aforementioned embodiments, the stacker 5 is vibrated so as to align the sheets P stacked on the stacker 5. Alternatively, as shown in FIG. 4, a stacker 5 which has a bottom and is open upward, may be disposed horizontally, and, in the stacker 5, there may be provided a movable side plate 58 which can move closer to and away from the side edge of the bundle of the sheets P. The movable side plate 58 is moved by an air cylinder 63 provided in a side of the stacker 5 in a left-right direction in FIG. 4 so as to press the bundle of the sheets P at the side edge thereof toward a side wall 53 placed at a left edge of the stacker 5. The air cylinder 63 is connected to the adjust portion 62, which controls a pressing force for the bundle of the sheets P in the left-right direction. In this case, the conveyor 55 which supports the bundle of the sheets P dropped from the stacker 5 is oriented such that the conveyor 55 conveys the bundle of the sheets P horizontally.

The table of the determination portion 61 stores data regarding the number of the sheets P which is to be stacked on the stacker 5 with respect to the information regarding the recorded surface, and data regarding an electric voltage which is to be supplied to the air cylinder 63 in order to press the sheets P toward the side wall 53 with the pressing force in accordance with the number of the sheets P. Accordingly, when the information regarding the recorded surface of the sheet P is inputted, the determination portion 61 outputs, to the control portion 6, data regarding a value of the number N of the sheets P which is to be stacked on the stacker 5 with respect to the information, and a value of the electric voltage which is to be supplied to the air cylinder 63 in accordance with the information.

Figures 5A, 5B:
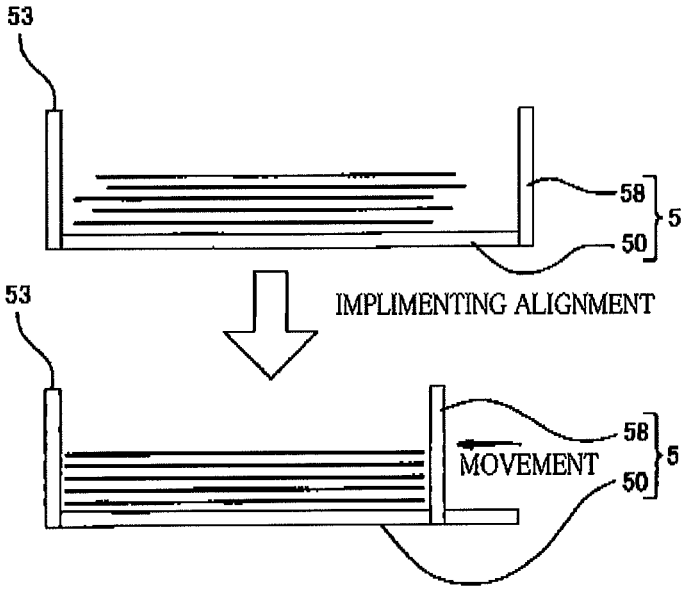
FIGS. 5 (*a*) and (*b*) are schematic views showing a sheet aligning operation of the stacker in FIG. 4.

As shown in FIG. 5(*a*), the plurality of sheets P conveyed from the image forming apparatus 2 is stacked on the stacker 5 in a state in which the sheets P are not aligned. As shown in FIG. 5(*b*), the air cylinder 63 presses the movable side plate 58 so as to make the bundle of the sheets P come into abutting contact with the side wall 53, thereby aligning the bundle of the sheets P.

The number of the sheets P which is to be stacked on the stacker 5 or the pressing force of the air cylinder 63 varies in accordance with the friction coefficient and the friction resistance on the recorded surface of the sheet P. In detail, as described above, the friction coefficient or the friction resistance on the recorded surface of the sheet P becomes larger in the case in which (i) the recorded area on the sheet P is larger, (ii) the ejection amount of the inks is larger, (iii) the two-side printing is performed, or (iv) the pre-coat treatment is performed. Therefore, in this case, at least one of the number of the sheets P which is to be stacked on the stacker 5 needs to be reduced, and the pressing force of the air cylinder 63 needs to be increased.

The determination portion 61 receives, from the control device 9 via the receiving device 60, information indicating that the friction coefficient or the friction resistance on the recorded surface of the sheet P becomes larger. The determination portion 61 complies with the information regarding the recorded surface and sends, to the control portion 6, at least one of (i) a signal for a command that the number N of the sheets P which is to be stacked on the stacker 5 is reduced, and (ii) a signal for a command that the pressing force of the air cylinder 63 is increased, on the basis of the table of the determination portion 61.

The control portion 6 reduces the number N of the sheets P stored in the memory of the adjust portion 62, which is to be stacked on the stacker 5. Then, when the number N pieces of the sheets P are stacked on the stacker 5, the air cylinder 63 presses the bundle of the sheets P toward the side wall 53.

Alternatively, the control portion 6 does not change the number N of the sheets P stored in the memory of the adjust portion 62, which is to be stacked on the stacker 5, but orders the adjust portion 62 to function after the number N pieces of the sheets P are stacked on the stacker 5. The adjust portion 62 orders the air cylinder 63 to actuate so as to press the bundle of the sheets P laterally with the pressing force larger than that in the case of low friction coefficient or low friction resistance on the recorded surface. Therefore, even though the friction coefficient or the friction resistance is relatively large on the recorded surface of the printed sheets P, the bundle of the sheets P can be correctly aligned.

On the contrary, the friction coefficient or the friction resistance on the recorded surface of the sheet P becomes smaller in the case in which (i) the recorded area on the sheet P is smaller, (ii) the ejection amount of the inks is smaller, (iii) the two-side printing is not performed, or (iv) the pre-coat treatment is not performed. Accordingly, in this case, compared with the case in which the recorded area on the sheet P is larger, or the ejection amount of the inks is larger, the number N of the sheets P which is to be stacked on the stacker 5 is increased, or the pressing force of the air cylinder 63 is decreased.

The determination portion 61 receives, from the control device 9 via the receiving device 60, information indicating that the friction coefficient or the friction resistance on the recorded surface of the sheet P becomes smaller. The determination portion 61 complies with the information regarding the recorded surface and sends, to the control portion 6, at least one of (i) a signal for a command that the number N of the sheets P which is to be stacked on the stacker 5 is changed, and (ii) a signal for a command that the pressing force of the air cylinder 63 is decreased, on the basis of the table of the determination portion 61.

The control portion 6 changes the number N of the sheets P stored in the memory of the adjust portion 62, which is to be stacked on the stacker 5. Then, when the number N pieces of the sheets P are stacked on the stacker 5, the air cylinder 63 presses the bundle of the sheets P toward the side wall 53.

Alternatively, the control portion 6 does not change the number N of the sheets P stored in the memory of the adjust portion 62, which is to be stacked on the stacker 5, but orders the adjust portion 62 to function after the number N pieces of the sheets P are stacked on the stacker 5. The adjust portion 62 orders the air cylinder 63 to actuate so as to press the bundle of the sheets P laterally with the pressing force smaller than that in the case of the large friction coefficient or the large friction resistance on the recorded surface. Since the bundle of the sheets P is not pressed with an excessive force, it is possible to decrease a possibility for causing damage on the sheet P.

Though the stacker 5 shown in FIGS. 2(*a*) and 2(*b*) is tilted such that the left edge thereof is lower than the right edge thereof, the stacker 5 may be tilted such that the right edge is lower than the left edge. Additionally, though the image forming apparatus 2 is the ink-jet printer, it may be alternatively a laser printer or a thermal printer. The image forming apparatus 2 may be integral with or separate from the recording medium post-processing apparatus 1.

The treatment liquid used in the aforementioned embodiment is a liquid which decreases, by ejecting it onto the sheet P beforehand, a degree of penetration of the ink which is to be ejected afterward onto the sheet P. Alternatively, a treatment liquid which is landed on the ejected ink so as to improve solidification of the ink on the sheet P, namely, a post-treatment liquid (a post-coating liquid) may be used. In this case, the treatment liquid head 21*a* is arranged in a downstream side of the four ink heads 21 in the forward conveying direction In addition, though the sheet P is illustrated as the recording medium, for example, a film or a plastic sheet may be used as the recording medium.

Moreover, the technical features of the aforementioned embodiments may be implemented in combination. For example, in the third embodiment, in a case in which the period from the time when the printed sheets P has supplied from the image forming apparatus 2 to the time when the next recording medium P is supplied from the image forming apparatus 2 exceeds the threshold thereof, when the bundle of the sheets P is aligned within the aforementioned period. However, in the third embodiment or other embodiments, the number of the sheets P which is to be stacked on the stacker 5 or the magnitude of the external force to be applied to the sheets P may be determined on the basis of the recorded area, the ejection amount of the inks, the one-side or two-side printing, the type of the sheet P, or the presence or absence of the pre-coat treatment.

In addition, when the number of the sheets P which is to be stacked on the stacker 5 or the magnitude of the external force to be applied to the sheets P is determined on the basis of the one-side or two-side printing, the recorded area or the ejection amount of the inks may also be taken into consideration.

It is noted that a used amount of the inks may vary in accordance with a content of a color printing even when the recorded areas are equal. For example, in a comparison between a single color printing and a multi-color printing, the used amount of the inks is greater in the multi-color printing even when their respective recorded areas are equal. As described above, since each of the inks has the viscosity, the friction coefficient on the recorded surface becomes larger as the used amount of the inks is larger.

Accordingly, when the number of the sheets P which is to be stacked on the stacker 5 or the magnitude of the external force to be applied to the sheets P is determined on the basis of the recorded area, the ejection amount of the inks (the used amount of the inkes) may also be taken into consideration.

Incidentally, in the aforementioned embodiments, the control device 9 may be configured by one or more CPUs, a specific ASIC (Application Specific Integrated Circuit), or a combination of a CPU and an ASIC.

The present invention is applicable to recording medium post-processing apparatuses which align a bundle of sheets after a printing.

What is claimed is:

1. A recording medium post-processing apparatus comprising:

a stacker configured to be stacked with a plurality of sheet-like recording media with images being recorded thereon;

an alignment device configured to apply an external force to the plurality of recording media stacked on the stacker so as to align the plurality of recording media stacked on the stacker;

a receiver configured to receive a kind of a currently-stacked-recording-media that is a plurality of recording media being currently stacked on the stacker; and a controller configured to:

set a reference number to a first value when a kind of the currently-stacked-recording-media is a first kind of the recording media;

set the reference number to a second value when a kind of the currently-stacked-recording-media is a second kind of the recording media, the second value being less than the first value, a friction coefficient of the second kind of the recording media being larger than that of the first kind of the recording media;

obtain a number of a currently-stacked-recording-media; and control the alignment device to apply the external force to the currently-stacked-recording media when the number of the currently-stacked-recording-media reaches the reference number.

2. A printer unit comprising:

the recording medium post-processing apparatus according to claim 1; and an image forming apparatus configured to supply the recording media to the stacker of the recording medium post-processing apparatus.

3. A recording medium post-treatment method of a recording medium post-processing apparatus which comprises (i) a stacker configured to be stacked with a plurality of sheet-like recording media with images being recorded thereon, (ii) an alignment device configured to apply an external force to the plurality of recording media stacked on the stacker so as to align the plurality of recording media stacked on the stacker, and (iii) a receiver configured to receive a kind of a currently-stacked-recording-media that is a plurality of recording media being currently stacked on the stacker, comprising:

a step of setting a reference number to a first value when a kind of the currently-stacked-recording-media is a first kind of the recording media;

a step of setting the reference number to a second value when a kind of the currently-stacked-recording-media is a second kind of the recording media, the second value being less than the first value, a friction coefficient of the second kind of the recording media being larger than that of the first kind of the recording media;

a step of obtaining a number of a currently-stacked-recording-media; and a step of controlling the alignment device to apply the external force to the currently-stacked-recording media when the number of the currently-stacked-recording-media reaches the reference number.

4. A non-transitory, computer-readable medium storing computer-readable instructions therein that, when executed by a processor of a recording medium post-processing apparatus which comprises (i) a stacker configured to be stacked with a plurality of sheet-like recording media with images being recorded thereon, (ii) an alignment device configured to apply an external force to the plurality of recording media stacked on the stacker so as to align the plurality of recording media stacked on the stacker, and (iii) a receiver configured to receive a kind of a currently-stacked-recording-media that is a plurality of recording media being currently stacked on the stacker, cause the recording medium post-processing apparatus to perform the steps of:

setting a reference number to a first value when a kind of the currently-stacked-recording-media is a first kind of the recording media;

setting the reference number to a second value when a kind of the currently-stacked-recording-media is a second kind of the recording media, the second value being less than the first value, a friction coefficient of the second kind of the recording media being larger than that of the first kind of the recording media;

obtaining a number of a currently-stacked-recording-media;

controlling the alignment device to apply the external force to the currently-stacked-recording media when the number of the currently-stacked-recording-media reaches the reference number.

5. A recording medium post-processing apparatus comprising:

a stacker configured to be stacked with a plurality of sheet-like recording media with images being recorded thereon;

an alignment device configured to apply an external force to the plurality of recording media stacked on the stacker so as to align the plurality of recording media stacked on the stacker, a magnitude of the external force being a reference value;

a receiver configured to receive a kind of a currently-stacked-recording-media that is a plurality of recording media being currently stacked on the stacker; and a controller configured to:

set a reference number to a first value when a kind of the currently-stacked-recording-media is a first kind of the recording media;

set the reference number to a second value when a kind of the currently-stacked-recording-media is a second kind of the recording media, the second value being less than the first value, a friction coefficient of the second kind of the recording media being larger than that of the first kind of the recording media;

obtain a number of a currently-stacked-recording-media; and control the alignment device to apply a first external force to the currently-stacked-recording media when the number of the currently-stacked-recording-media reaches the reference number.

* * * * *